US010107022B2

(12) United States Patent
Abramson et al.

(10) Patent No.: US 10,107,022 B2
(45) Date of Patent: Oct. 23, 2018

(54) DRAFT GUARD FOR WINDOW ASSEMBLY HAVING SEALS AND INTEGRAL FINS

(71) Applicants: Greenstar Technologies, LLC, Victor, NY (US); Henniges Automotive Schlegal Canada, Inc., Burlington (CA)

(72) Inventors: Steven Robert Abramson, Victor, NY (US); Gavin Patrick Abramson, Victor, NY (US); Joseph Henry, Oklahoma City, OK (US)

(73) Assignees: HENNIGES AUTOMOTIVE SCHLEGEL CANADA, INC., Burlington, Ontario (CA); GREENSTAR TECHNOLOGIES, LLC, Victor, NY (US)

( * ) Notice: Subject to any disclaimer, the term of this patent is extended or adjusted under 35 U.S.C. 154(b) by 0 days.

(21) Appl. No.: 14/667,811

(22) Filed: Mar. 25, 2015

(65) Prior Publication Data

US 2015/0197980 A1 Jul. 16, 2015

Related U.S. Application Data

(63) Continuation-in-part of application No. 14/259,986, filed on Apr. 23, 2014, which is a continuation of (Continued)

(51) Int. Cl.
*E05F 1/00* (2006.01)
*E05D 13/00* (2006.01)
(Continued)

(52) U.S. Cl.
CPC ..... *E05D 13/12* (2013.01); *E06B 7/16* (2013.01); *E06B 7/2305* (2013.01); *E06B 3/4415* (2013.01); *Y10T 16/64* (2015.01)

(58) Field of Classification Search
CPC ..... E06B 7/02; E06B 7/16; E06B 7/23; E06B 7/2305; E06B 7/2314; E06B 3/4415; E05D 15/22
(Continued)

(56) References Cited

U.S. PATENT DOCUMENTS 2,044,916 A * 6/1936 Neumuth ..... E06B 7/16 49/406
2,778,068 A * 1/1957 Kaufman ..... E06B 3/50 49/181
(Continued)

FOREIGN PATENT DOCUMENTS

WO 2008119968 A2 10/2008

OTHER PUBLICATIONS

Final Office Action dated Jun. 28, 2016 for U.S. Appl. No. 14/259,986.
Canadian Office Action dated Mar. 22, 2017; 3 pages.

*Primary Examiner* — Jerry E Redman
(74) *Attorney, Agent, or Firm* — Howard & Howard Attorneys PLLC

(57) ABSTRACT

A draft guard for a window assembly includes a piece of weatherstopping material and a bend in the piece of weatherstopping material with the bend defining a horizontal component and a vertical component angularly offset from the horizontal component, a foam seal forming a closed member around the horizontal component and extending outwardly from the horizontal component, and at least one fin extending outwardly from and integral with at least one side of the vertical component.

22 Claims, 11 Drawing Sheets

Related U.S. Application Data application No. 13/155,382, filed on Jun. 7, 2011, now abandoned.

(51) Int. Cl.
*E06B 7/23* (2006.01)
*E06B 7/16* (2006.01)
*E06B 3/44* (2006.01)

(58) Field of Classification Search
USPC ..... 49/176, 181, 445, 447
See application file for complete search history.

(56) References Cited

U.S. PATENT DOCUMENTS 3,055,063 A 9/1962 Peters
3,157,917 A 11/1964 Peters
3,434,236 A 3/1969 Weidner et al.
3,482,354 A * 12/1969 Trout ..... E06B 3/50 49/181
3,524,282 A 8/1970 Kraft et al.
4,134,402 A 1/1979 Mahurkar
4,170,090 A * 10/1979 Wood ..... E05D 13/1207 49/176
4,363,190 A * 12/1982 Anderson ..... E05D 15/22 49/181
4,403,983 A 9/1983 Edelman et al.
4,563,170 A 1/1986 Aigner
4,568,329 A 2/1986 Mahurkar
4,583,968 A 4/1986 Mahurkar
4,623,327 A 11/1986 Mahurkar
4,785,581 A * 11/1988 Abramson ..... E05D 15/22 49/176
4,808,155 A 2/1989 Mahurkar
4,888,915 A 12/1989 Goldenberg
4,895,561 A 1/1990 Mahurkar
4,926,524 A 5/1990 Owens
4,985,014 A 1/1991 Orejola
5,036,622 A 8/1991 Stark
5,053,023 A 10/1991 Martin
5,069,001 A 12/1991 Makarowski
5,117,586 A * 6/1992 Stark ..... E05D 13/08 49/429
5,168,665 A 12/1992 Goldenberg
5,174,064 A 12/1992 Stark
5,197,951 A 3/1993 Mahurkar
5,221,255 A 6/1993 Mahurkar
5,237,775 A 8/1993 Hardy
5,380,276 A 1/1995 Miller et al.
5,406,749 A 4/1995 Goldenberg
5,425,724 A 6/1995 Akins
5,444,790 A * 8/1995 Kogen ..... H04R 1/086 381/189
5,451,207 A 9/1995 Yock
5,566,507 A 10/1996 Schmidt et al.
5,571,093 A 11/1996 Cruz et al.
5,584,803 A 12/1996 Stevens et al.
5,657,579 A 8/1997 Bruchu et al.
5,661,927 A 9/1997 Polowinczak et al.
5,669,180 A 9/1997 Maier
5,697,905 A 12/1997 d'Ambrosio
5,718,692 A 2/1998 Schon et al.
5,807,311 A 9/1998 Palestrant
5,868,717 A 2/1999 Prosl
5,927,014 A 7/1999 Goldenberg
6,099,506 A 8/2000 Macoviak et al.
6,106,497 A 8/2000 Wang
6,178,695 B1 1/2001 Kornegay et al.
6,387,037 B1 5/2002 Bolling et al.
6,532,964 B2 3/2003 Aboul-Hosn et al.
6,550,184 B1 4/2003 O'Donnell et al.
6,658,794 B1 12/2003 Hansel et al.
6,689,149 B2 2/2004 Maahs
6,726,651 B1 4/2004 Robinson et al.
6,804,913 B2 10/2004 Pipin
6,827,701 B2 12/2004 MacMahon et al.
6,926,662 B1 8/2005 Aboul-Hosn et al.
6,966,886 B2 11/2005 Appling
7,048,680 B2 5/2006 Viole et al.
7,069,621 B2 7/2006 Malek
7,076,835 B2 7/2006 Harold et al.
7,088,395 B2 8/2006 Takayama et al.
7,223,254 B2 5/2007 Hjalmarsson
7,282,041 B2 10/2007 Igarashi et al.
7,294,117 B2 11/2007 Provost-tine et al.
7,465,286 B2 12/2008 Patterson et al.
7,470,363 B2 12/2008 Milo
7,608,063 B2 10/2009 Le et al.
7,615,034 B2 11/2009 DiFiore
7,726,073 B2 6/2010 Ifko
7,753,868 B2 7/2010 Hoffa
7,833,157 B2 11/2010 Gottlieb et al.
8,066,660 B2 11/2011 Gregersen et al.
8,075,510 B2 12/2011 Aklog et al.
8,092,415 B2 1/2012 Moehle et al.
8,172,792 B2 5/2012 Wang et al.
8,198,210 B2 6/2012 Gadkaree et al.
8,337,451 B2 12/2012 Lareau et al.
8,435,204 B2 5/2013 Lad et al.
8,505,242 B1 8/2013 Kunz
8,523,757 B2 9/2013 Taub et al.
9,181,748 B2 * 11/2015 Sofianek ..... E06B 7/16
2001/0020160 A1 9/2001 Esch et al.
2002/0111583 A1 8/2002 Wright
2002/0138031 A1 9/2002 Ross
2003/0145523 A1 8/2003 Annes
2003/0221561 A1 12/2003 Milo
2004/0206002 A1 10/2004 Kunz et al.
2004/0206003 A1 10/2004 Kunz et al.
2004/0210180 A1 10/2004 Altman
2005/0004504 A1 1/2005 Frye et al.
2005/0182352 A1 8/2005 DiMatteo et al.
2006/0225362 A1 10/2006 Pettit et al.
2006/0230682 A1 10/2006 Ifko
2006/0254151 A1 * 11/2006 Curtis ..... E06B 3/44 49/414
2007/0056216 A1 3/2007 Liang et al.
2007/0101654 A1 * 5/2007 Robertson ..... E05D 13/1276 49/445
2007/0113479 A1 * 5/2007 Uken ..... E05D 13/08 49/181
2007/0256462 A1 * 11/2007 VerSteeg ..... E05D 7/1044 70/90
2008/0047099 A1 * 2/2008 Malek ..... E05C 17/60 16/197
2008/0116707 A1 * 5/2008 Boaz ..... B60P 3/34 296/26.01
2009/0064589 A1 3/2009 Tyler
2009/0157051 A1 6/2009 Appling et al.
2011/0105984 A1 5/2011 Patel et al.
2011/0106135 A1 5/2011 Thompson et al.
2012/0088955 A1 4/2012 Taub et al.
2013/0046224 A1 2/2013 Ravenscroft et al.
2013/0274643 A1 10/2013 Taub et al.
2013/0289527 A1 10/2013 Ravenscroft
2014/0024998 A1 1/2014 Prosl et al.
2014/0041309 A1 * 2/2014 Sofianek ..... E06B 7/16 49/424
2014/0230331 A1 8/2014 Kellum, III

* cited by examiner

DRAFT GUARD FOR WINDOW ASSEMBLY HAVING SEALS AND INTEGRAL FINS

CROSS-REFERENCE TO RELATED APPLICATION(S)

The present application is a continuation-in-part of Ser. No. 14/259,986, filed Apr. 23, 2014, which is a continuation of Ser. No. 13/155,382, filed Jun. 7, 2011, now abandoned.

BACKGROUND OF THE INVENTION

1. Field of the Invention

The present invention relates generally to draft guards for windows and, more particularly to, a draft guard having a foam seal and integral fins for a window assembly.

2. Description of the Related Art

Fenestration products, such as windows and doors, clearly benefit from weather barriers such as weatherstripping as well as sound and tight fitting interrelational parts and components. Such weather barriers serve not only to prevent drafts, but also deter moisture entry as well as insect, dust and pollen infiltration. Over the years, energy efficiency standards as well as an overall awareness of the environmental benefits of energy efficient fenestration products have furthered the demand for proper and improved weather barriers, seals, and fittings. Many improved weatherstripping products now exist to perimeter seal windows and doors.

While perimeter weatherstrips are necessary and highly beneficial, there are small openings in windows and doors that, without proper seals, can leak air, water, dust, pollen or even insects into the interior airspace of a building. Often these small openings are due to an interoperable mechanical arrangement that may be difficult to seal off without impacting the mechanical functionality between attendant components. One example of such a situation is that of the ever popular double hung window. A double hung window commonly has two sashes that travel vertically in a tracked frame. A spring assembly is often utilized to facilitate ease of vertical travel of each sash. Oftentimes, a pivot bar inserts into a balancer shoe which connects to a spring assembly to allow a sash to tilt out for cleaning. The use of a tracked frame and a traveling sash setup, while practical, creates a break in the weather barrier of the window that allows air, dust, pollen, moisture, or even insects, to travel up the track and into the building. In a strong wind, the track may even create a chimney effect where cold outside air is forced up the track and into the building through the meeting rail and sill areas. Since the sashes and related components move in the track, it has been difficult to properly weather seal this area meeting rail of a double hung window.

It is therefore one desire of the present invention to provide a draft guard that seals the track of a double hung window from environmental factors. It is another desire of the present invention to provide a draft guard that travels with a moveable window sash in a double hung window. It is yet another desire of the present invention to provide a draft guard that works in conjunction with a pivoting sash arrangement for a double hung window. It is still another desire of the present invention to provide a draft guard that does not interfere with normal usage movement of a sash in a double hung window. It is a further desire of the present invention to provide a window balancer with a draft guard. It is yet another desire of the present invention to provide a method of manufacturing a double hung window. Therefore, there is a need in the art to provide a draft guard for a window assembly that meets at least one or all of these desires.

SUMMARY OF THE INVENTION

Accordingly, the present invention provides a draft guard for a window assembly including a piece of weatherstopping material and a bend in the piece of weatherstopping material with the bend defining a horizontal component and a vertical component angularly offset from the horizontal component. The draft guard also includes a formed foam seal forming a closed member around the horizontal component and extending outwardly from the horizontal component and at least one fin extending outwardly from and integral with at least one side of the vertical component.

One advantage of the present invention is that a new draft guard is provided for a window assembly that includes a foam seal and fins that functionally stops the chimney effect. Another advantage of the present invention is that the draft guard is used in a fenestration product such as a double hung window. Yet another advantage of the present invention is that the draft guard works in conjunction with a pivoting sash arrangement for a double hung window. Still another advantage of the present invention is that the draft guard may be incorporated into the fenestration product during manufacture and assembly, or may, in some embodiments of the present invention, be added to an existing fenestration product either by fastening the draft guard to an existing balancer or balancer shoe, or replacing the balancer with a new balancer or new balancer shoe having a draft guard. A further advantage of the present invention is that the draft guard does not interfere with normal movement of a sash in a double hung window, which is allowing for proper operational force.

Other features and advantages of the present invention will be readily appreciated, as the same becomes better understood, after reading the subsequent description taken in conjunction with the accompanying drawings.

DESCRIPTION OF THE PREFERRED EMBODIMENT(S)

As disclosed in the present application, a draft guard, according to the present invention, is utilized with a window assembly. Balances or balancers, as used herein, describe the mechanical component or components that contain a spring or balance assembly that connects a window sash to a master frame to allow for ease of operation. While such balances or balancers are commonly used with double hung windows, other window arrangements may benefit from such hardware such as, for example, sliding windows. The windows may be wood, vinyl, aluminum, fiberglass, or the like. A window balancer configuration allows a window sash to be tilted in a plane outside its normal operating plane to allow for cleaning.

The present invention solves the problem of a draft or chimney effect originating from the hollow chamber tracks in a window frame and the space between a sash and master frame, by adding a draft guard component to a balance or balancer. The draft guard mechanically attaches to or is part of a constant force balancer and the balancer pivot bar at the balancer shoe of a constant force block and tackle or a spiral balancer. The present invention includes not only the draft guard, but a balance or balancer having a draft guard, along with a method of manufacturing fenestration products that have a draft guard. In addition, the present invention includes modifications, variations, additions, improvements and enhancements to the present invention that will be known or contemplated after reading this specification and the accompanying drawings. It should be appreciated that the draft guard may be formed as part of the casing.

Figure 1:
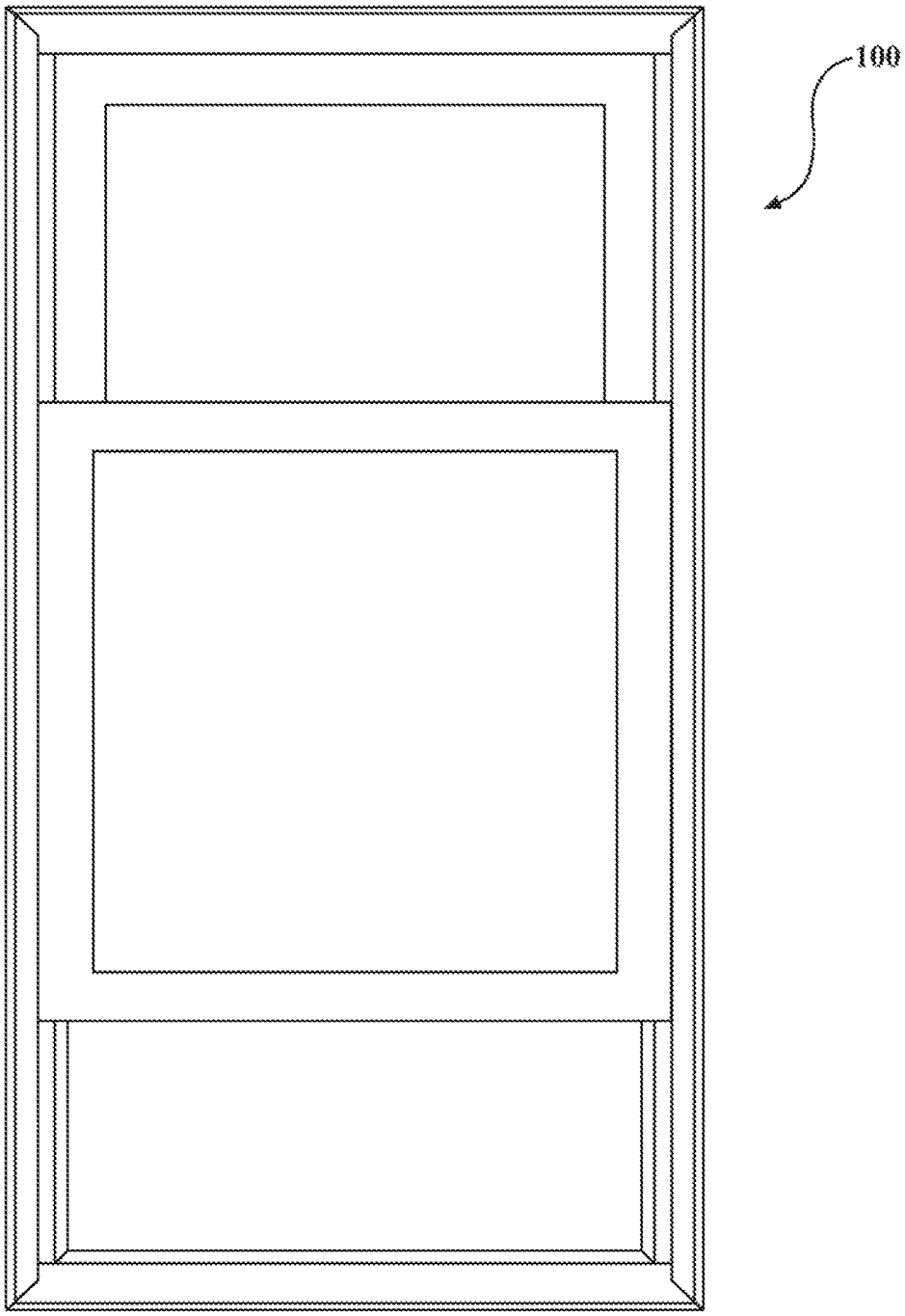
FIG. 1 is a plan view of a double hung window with cut line A-A.
Figure 2:
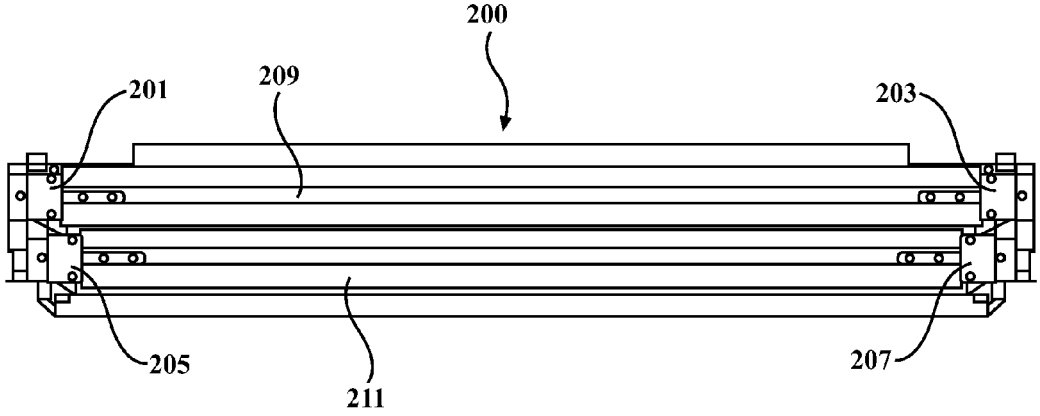
FIG. 2 is a bottom view of two window sashes of a double hung window.

For a better understanding of the present invention and the various embodiments described and envisioned herein, a double hung window is depicted in FIGS. 1 and 2. While arguably the most common application of the present invention, applicability is not limited to double hung windows, but the present invention may find suitable and useful applications in other fenestration products as well.

Referring to FIG. 1, a double hung window 100 is shown. Two window sashes can be seen contained by a tracked frame. The tracks are contained in the frame and make contact with the two vertical edges of each window sash. It is within these tracks that a balancer, spring and draft guard is contained. This arrangement can be better seen in FIG. 2, which is a bottom view 200 of a double hung window. The window extrusion chamber hollows can be clearly seen in this bottom view. A first sash 209 and a second sash 211 can be seen in FIG. 2. In addition, four draft guards can be seen, two per sash. A first draft guard 201 and a second draft guard 203 can be seen at either end of the first sash 209. In a similar arrangement, a third draft guard 205 and a fourth draft guard 207 can also be seen at either end of the second sash 211. The draft guards visible in FIG. 2 are attached to the bottom of a balancer arrangement that is also in use, but cannot be clearly seen in FIG. 2. The balancer arrangement provides mechanical connectivity between the moveable sash and the fixed master frame, with a spring or balance assembly therebetween for ease of operation. The details of such an arrangement will be further described by way of the remaining figures.

Figure 3:
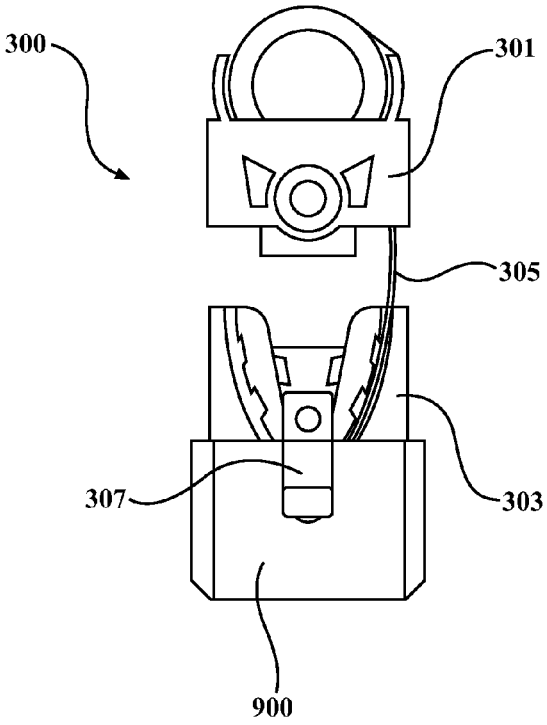
FIG. 3 is a front plan view of a balancer showing the draft guard in use.
Figure 4:
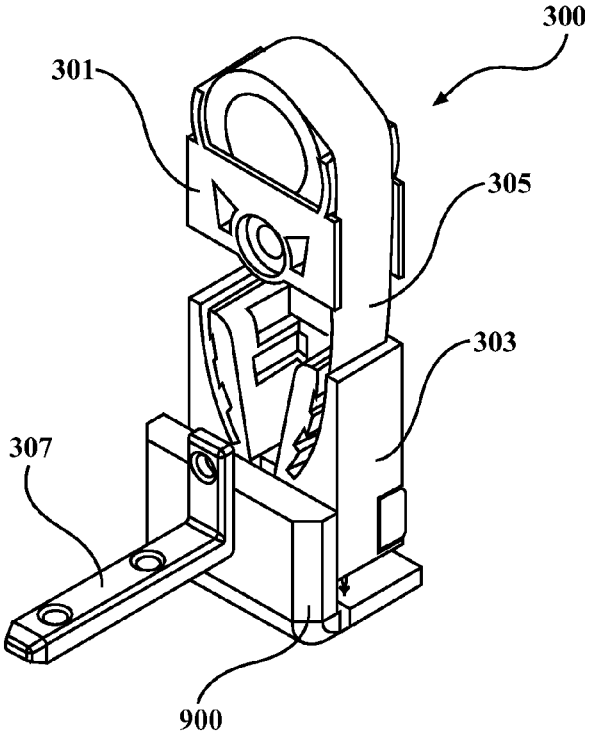
FIG. 4 is a perspective view of a balancer showing the draft guard in use.
Figure 5:
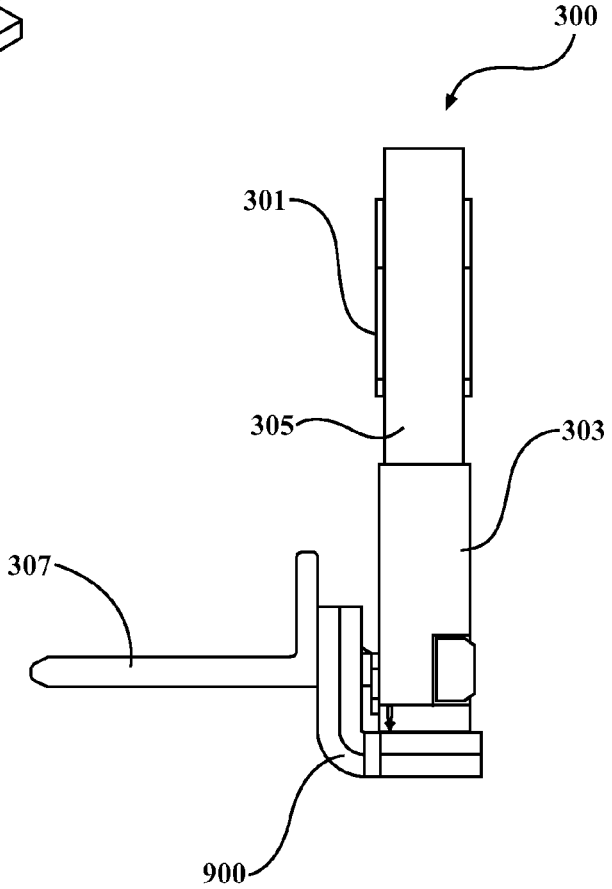
FIG. 5 is a right side view of a balancer showing the draft guard in use.
Figure 6:
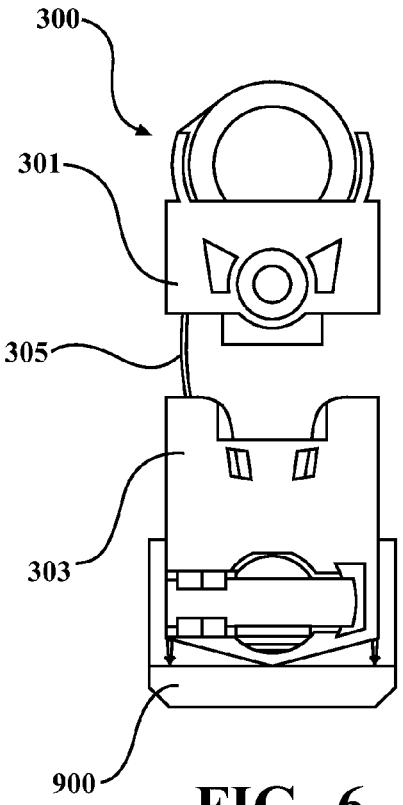
FIG. 6 is a rear plan view of a balancer showing the draft guard in use.
Figure 7:
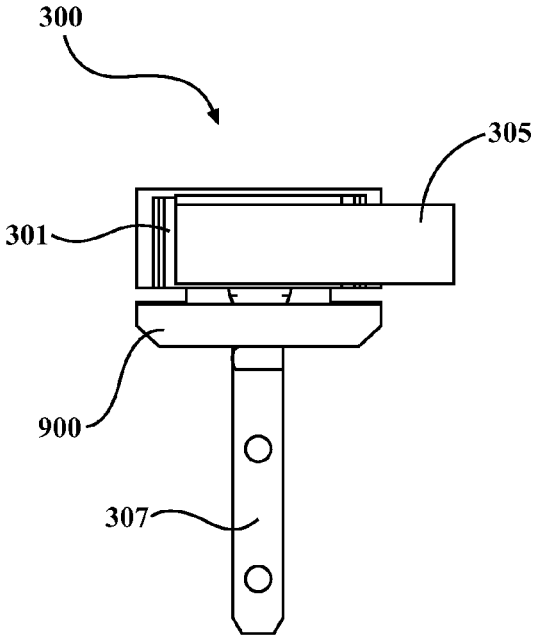
FIG. 7 is a top plan view of a balancer showing the draft guard in use.
Figure 8:
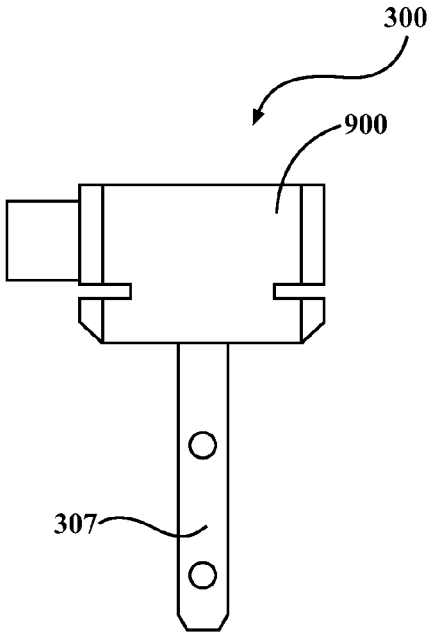
FIG. 8 is a bottom plan view of a balancer showing the draft guard in use.

FIGS. 3-8 depict a balancer system showing the draft guard in use. FIG. 3 is a front plan view of a balancer 300 and pivot bar 307 showing the draft guard in use. The upper structure in FIG. 3 is the frame side 301 of the balancer 300 and the lower structure in FIG. 3 is the sash side 303 of the balancer 300. The pivot bar 307 inserts into the shoe of the sash side 303 of the balancer 300. The frame side 301 of the balancer 300 and the sash side 303 of the balancer 300 may be made from a plastic such as polypropylene, nylon or the like, or from a metal such as aluminum. Preferentially, a material with a low coefficient of friction should be used to provide smooth operation. Various plastics fall into this category. The frame side 301 of the balancer 300 and the sash side 303 of the balancer 300 may be injection molded, or machined, for example. Between the frame side 301 of the balancer 300 and the sash side 303 of the balancer 300 is a spring 305. The spring 305 may be a constant force spring made from, for example, flat stock and wound steel or stainless steel. The spring 305 may also be a spiral spring or a block and tackle spring assembly, and may contain a separate balancer shoe not directly attached to a spring housing. Further depicted in FIG. 3 is a pivot bar 307. The pivot bar 307 can be better seen in FIG. 4. The pivot bar 307 is typically made from a metal such as steel, and may be coated, painted or galvanized for rust prevention. The pivot bar 307 is cast, machined or stamped and retains the bottom edge of a window sash connecting directly to a balancer shoe. The figures depict a three hole arrangement for placing screws through the pivot bar 307. Other configurations, such as two holes, one hole, four holes, and the like, and other fasteners may, in some embodiments of the present invention, be used. The pivot bar 307 may, in some embodiments of the present invention, pivot to allow the attached window sash to tilt for cleaning. In some embodiments, the pivot bar engages with a balancer shoe cam that in turn pushes a tab outward to create friction against the track that the balancer shoe rides in, thus allowing the window sash to be tilted for cleaning while maintaining a fixed position in the track. Connected to the balancer 300 and pivot bar 307 is a draft guard 900. FIGS. 9-16 depict the draft guard 900 removed from the balancer 300 and pivot bar 307. The draft guard 900 is attached to the pivot bar 307 and attaches to the balancer 300 with an adhesive, a barbed fastener, a rivet, a snap, a mechanical connecting guide, a hook and loop fastener, or the like. Mechanical coupling of the draft guard 900 is to the sash side 303 of the balancer 300. The placement of the draft guard 900, in use, prevents air, water, dirt, pollen, sound, or insect infiltration up the track and into the building. In addition, the draft guard 900 prevents dirt and debris from entering the track and creating unnecessary friction on the balance springs and hardware. In use, the draft guard 900 is bent along and makes contact with surfaces of the window assembly to provide enhanced and improved sealing. A full complement of views of the balancer 300 and draft guard 900 is conveyed by way of FIGS. 4-8. FIG. 4 is a perspective view of a balancer 300 and pivot bar 307 showing the draft guard 900 in use. FIG. 5 is a right side view of a balancer 300 showing the draft guard 900 in use. FIG. 6 is a rear plan view of a balancer 300 showing the draft guard 900 in use. FIG. 7 is a top plan view of a balancer 300 showing the draft guard 900 in use. FIG. 8 is a bottom plan view of a balancer 300 showing the draft guard 900 in use and also showing the pivot bar 307 in place.

Figure 9:
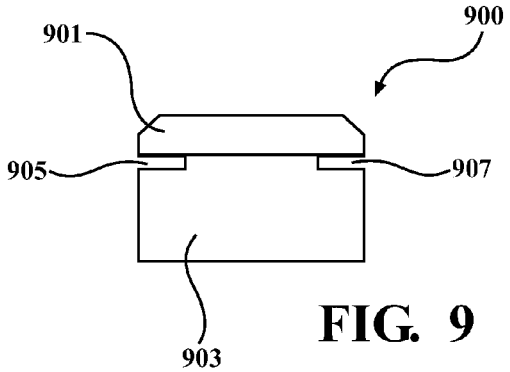
FIG. 9 is a top plan view of the draft guard.
Figure 10:
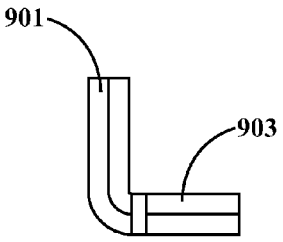
FIG. 10 is a left side view of the draft guard.
Figure 11:
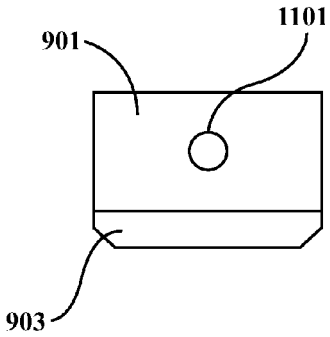
FIG. 11 is a front plan view of the draft guard.
Figure 12:
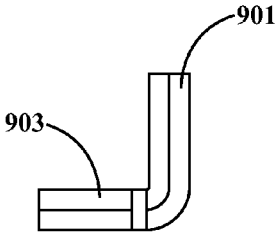
FIG. 12 is a right side view of the draft guard.
Figure 13:
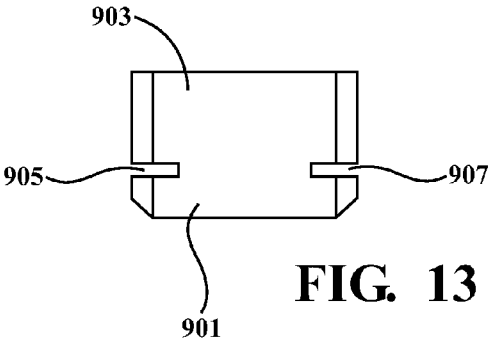
FIG. 13 is a bottom plan view of the draft guard.
Figure 14:
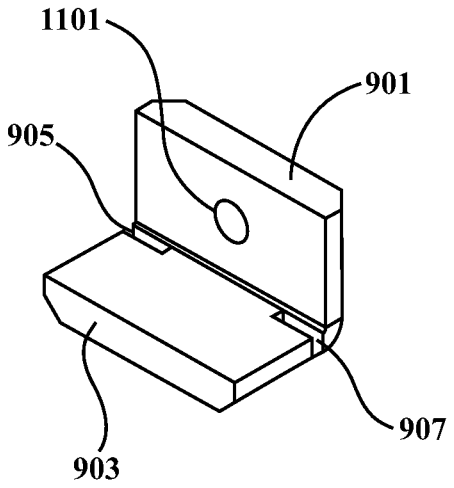
FIG. 14 is a perspective view of the draft guard.
Figure 15:
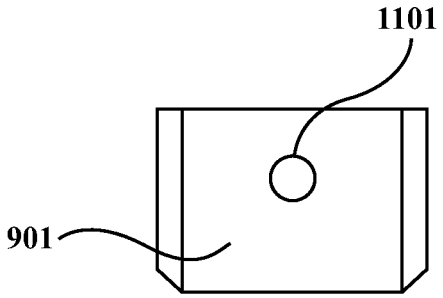
FIG. 15 is a rear plan view of the draft guard.
Figure 16:
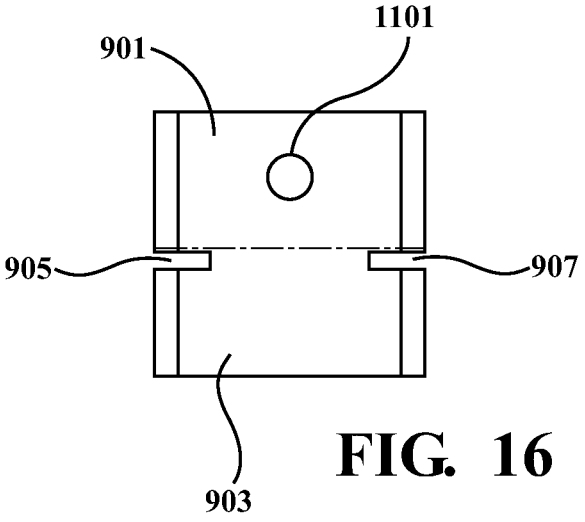
FIG. 16 is a flattened plan view of the draft guard.

FIGS. 9-16 depict the draft guard 900 removed from the balancer 300. The draft guard 900 is made from a weather-stopping material such as, for example, ethylene propylene diene monomer (EPDM) rubber, and extruded, die cut, or the like. Other materials that may be used to make the draft guard 900 are thermoplastic elastomers (TPE) that may be extruded, injection molded, die cut, or the like. Another material that may be used to make the draft guard 900 is thermoplastic polyolefin (TPO) and may be processed by injection molding, extruded, thermoformed, die cut, or the like. Other examples of materials that may be used to make the draft guard 900 include polystyrene, foam rubber, silicone, closed cell foam, felt, and the like. Materials used to make the draft guard 900 may also, in some embodiments of the present invention, be treated with an antimicrobial chemical to reduce mold, mildew and degradation related to other organism. An example of such treatment is disclosed in U.S. Pat. No. 5,681,637 to Kessler and Abramson and entitled "Microorganism Resistant Pile Weatherstripping", the entire disclosure of which is incorporated herein by reference. FIG. 9 is a top plan view of the draft guard 900. The draft guard 900 includes a vertical component 901 and a horizontal component 903. The vertical component 901 has a generally rectangular shape and has a first edge, a second edge, a third edge and a fourth edge. The vertical component 901 can be more clearly seen in FIG. 14. The vertical component 901 has a pivot bar hole 1101 that can be seen in FIG. 14 to accommodate the pivot bar which in turn attaches to the balancer shoe area of a balancer, (not shown in FIG. 9, see FIG. 4). The vertical component 901 is joined to the horizontal component 903 at a generally right angle. The horizontal component 903 has a generally rectangular shape and has a first edge, a second edge, a third edge and a fourth edge. The horizontal component 903 further has a first cut 905 and a second cut 907 in proximity to and generally parallel to the second edge. Various embodiments of the draft guard of the present invention may have varying cuts, thicknesses, shapes, and materials that are based, for example, on specifications of the window. In some embodiments the vertical component 901 and the horizontal component 903 are made from a single material and may be formed as one part. Processes to allow the horizontal component 903 and the vertical component 901 to be formed as one part include, but are not limited to, injection molding, extruding, and the like. FIG. 10 is a left side view of the draft guard 900. FIG. 11 is a front plan view of the draft guard 900. The pivot bar hole 1101 can be clearly seen. The pivot bar hole 1101 accommodates the pivot bar of the balancer shoe (not shown in FIG. 11, see FIG. 4). In some embodiments, the pivot bar hole 1101 may be round, oval, square, rectangular, octagonal, or of another geometry that allows a pivot bar to pass freely. FIG. 12 is a right side view of the draft guard 900. FIG. 13 is a bottom plan view of the draft guard 900. In some embodiments of the present invention, the first and third edges of the horizontal component are beveled. As well, the first and third edges of the vertical component may also be beveled. The bevel may be a 45 degree bevel, or may be of some other angle, or may be a roundover with any radius useful in reducing the sharp angle of the edge and thus provide ease of operation and reduced friction in use. FIG. 14 is a perspective view of the draft guard 900 that clearly shows the orientation of the vertical and horizontal components and the attributes associated with each. FIG. 15 is a rear plan view of the draft guard 900. FIG. 16 is a flattened plan view of the draft guard that clearly shows both the horizontal and the vertical component. A dotted line indicates the fold line of the draft guard. In some embodiments of the present invention, the draft guard may be flat as shown in FIG. 16 prior to assembly and attachment to a pivot bar and balancer. In other embodiments of the present invention, the balancer may be molded or otherwise fabricated with a generally right angle already intrinsic in the draft guard, as shown, for example, in FIG. 14.

Figure 17:
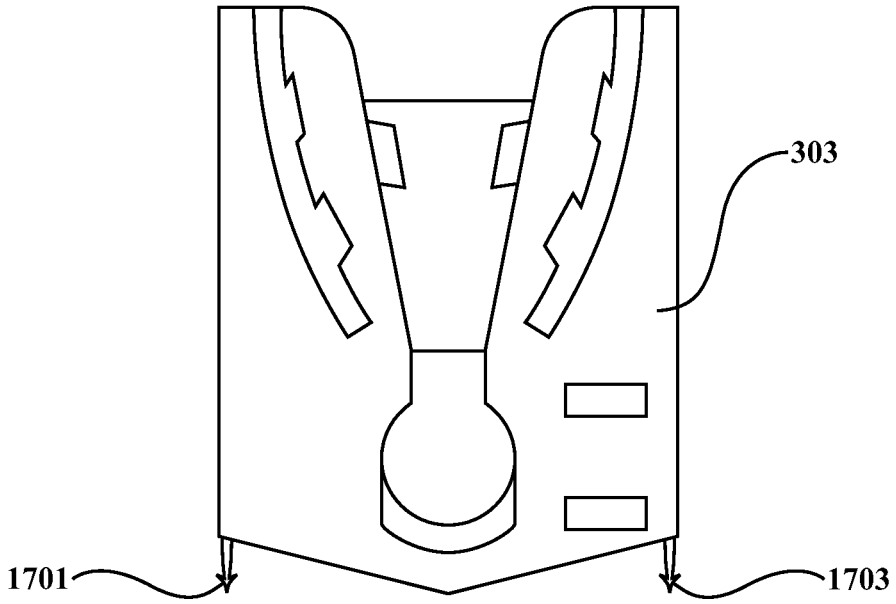
FIG. 17 is a plan view of the sash side of the balancer shoe.
Figure 18:
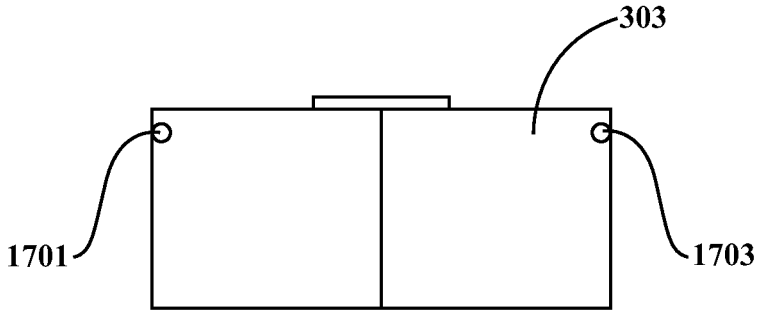
FIG. 18 is a bottom plan view of the sash side of the balancer shoe.
Figure 19:
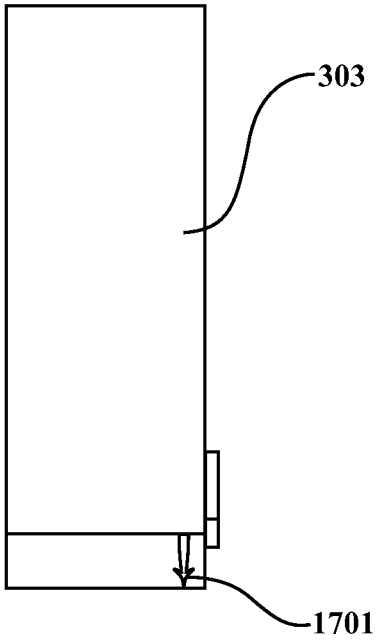
FIG. 19 is a left side view of the sash side of the balancer shoe.
Figure 20:
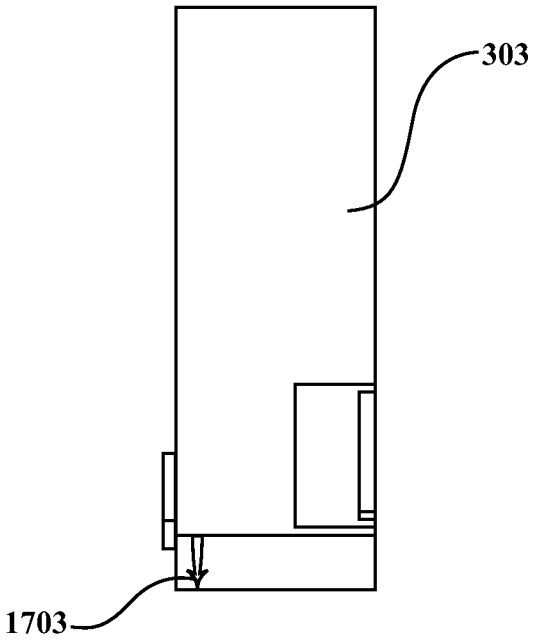
FIG. 20 is a right side view of the sash side of the balancer shoe.

Lastly, FIGS. 17-20 depict a constant force balancer with an exemplary mechanical coupling arrangement for coupling the draft guard 900 (not shown in FIGS. 17-20, see previous figures) to the sash side 303 of the balancer 300. The example in FIGS. 17-20 is not to be considered limiting. Adhesives, rivets, snaps, mechanical connecting guides, hook and loop fasteners, and other devices and techniques may be used alone or in combination to attach the draft guard 900 to the balancer 300. FIG. 17 is a plan view of the sash side 303 of the constant force balancer 300 showing an example of the use of a first fastener 1701 and a second fastener 1703 to retain the draft guard 900 to the balancer 300. The first fastener 1701 and the second fastener 1703 are barbs that may be molded into the sash side 303 of the balancer 300 or may be metal barbs that are inserted into the sash side 303 of the balancer 300 as a secondary operation. These barbs are also shown in FIG. 18 as a bottom plan view of the sash side 303 of the balancer 300. FIG. 19 is a left side view of the sash side 303 of the balancer 300 and FIG. 20 is a right side view of the sash side 303 of the balancer 300. Each of FIGS. 17-20 depicts an example of a mechanical coupling fastening technique. Other techniques may be used alone or in combination. The draft guard 900 will, however, be fastened securely to the sash side of the balancer 300 and pivot bar 307.

Figure 21:
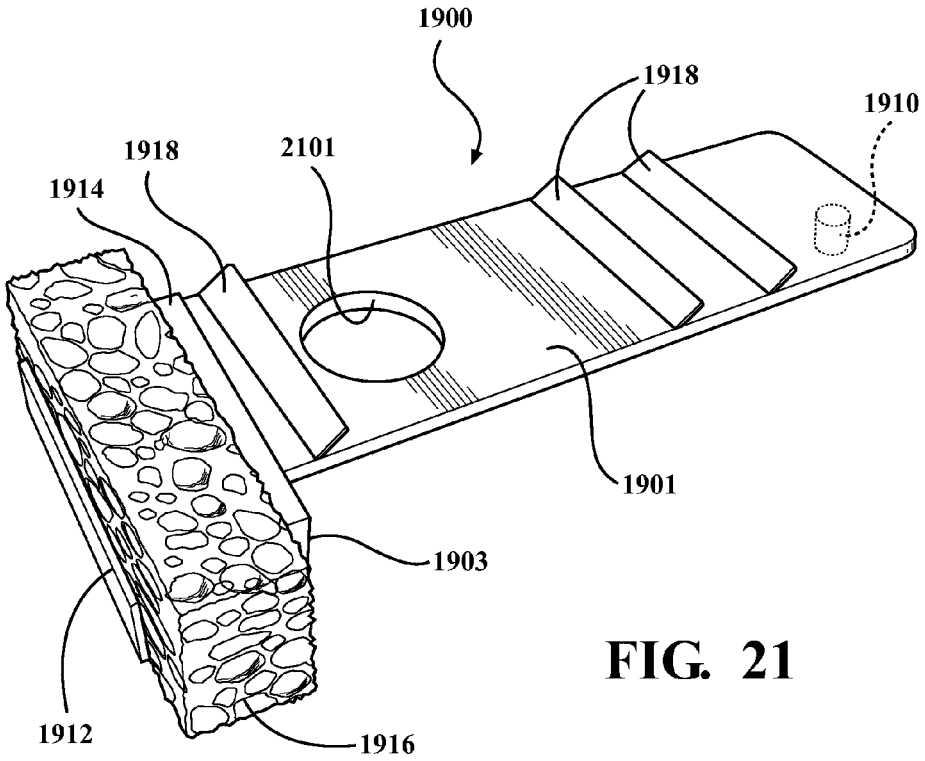
FIG. 21 is a perspective view of another embodiment, according to the present invention, of the draft guard.
Figure 22:
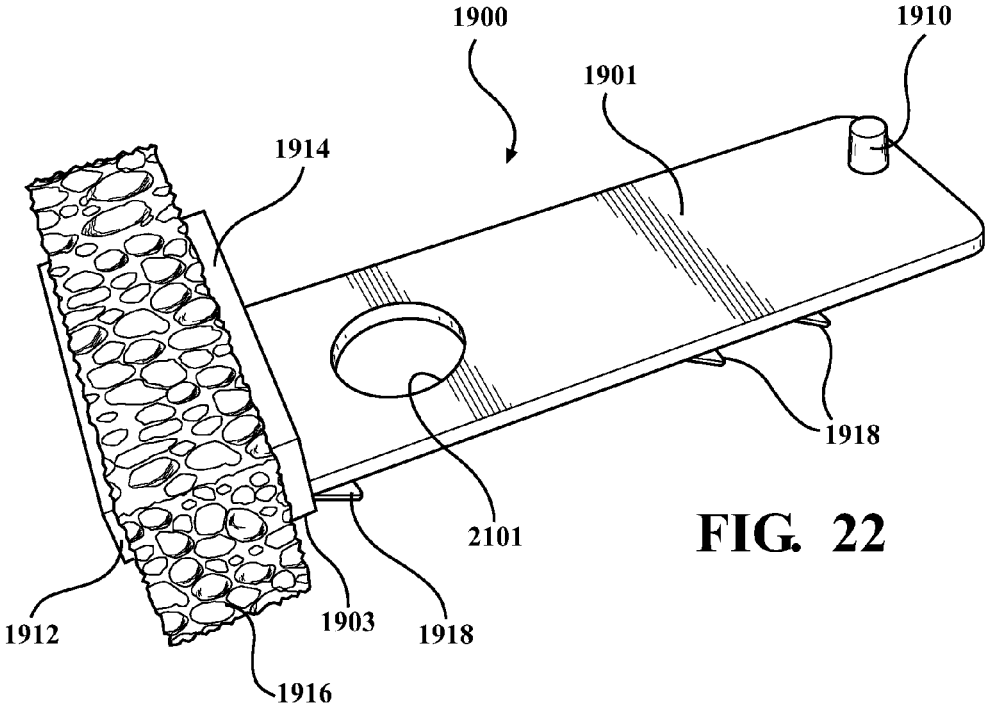
FIG. 22 is another perspective view of the draft guard of FIG. 21.
Figure 23:
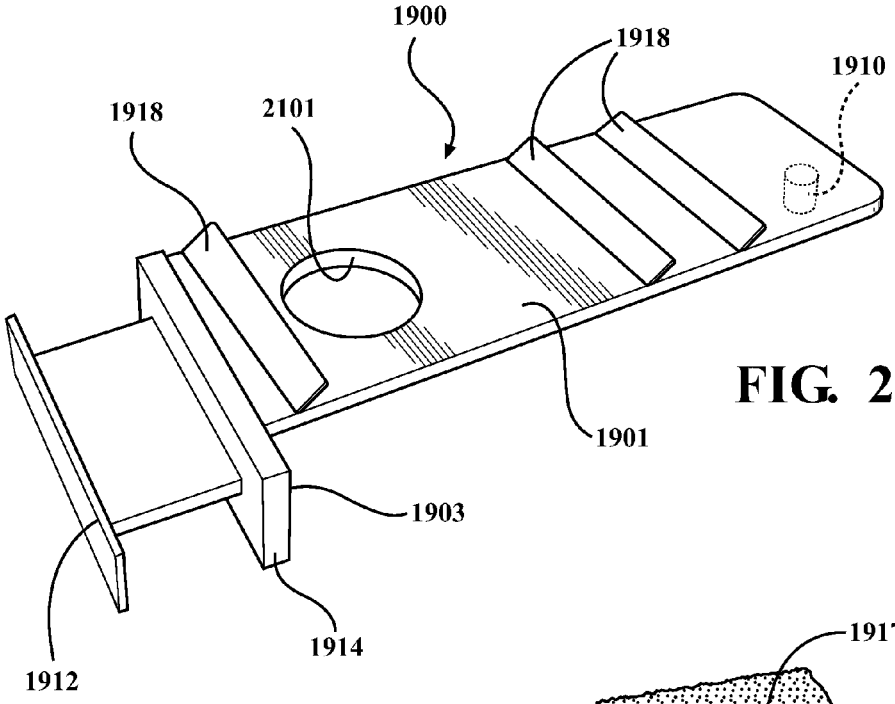
FIG. 23 is a view similar to FIG. 21 with a foam seal removed.

Referring to FIGS. 21 and 22, another embodiment, according to the present invention, of the draft guard 900 is shown for a window assembly. Like parts of the draft guard 900 have like reference numerals increased by one thousand (1000). In this embodiment, the draft guard 1900 includes a piece of weatherstopping material such as, for example, ethylene propylene diene monomer (EPDM) rubber, and extruded, die cut, or the like. Other materials that may be used to make the draft guard 1900 are thermoplastic elastomers (TPE) that may be extruded, injection molded, die cut, or the like. Another material that may be used to make the draft guard 1900 is thermoplastic polyolefin (TPO) and may be processed by injection molding, extruded, thermoformed, die cut, or the like. Yet another material that may be used to make the draft guard 1900 is thermoplastic polyvinyl chloride (PVC) and may be processed by injection molding, extruded, thermoformed, die cut, or the like. The draft guard 1900 includes a vertical component 1901 and a horizontal component 1903. The weatherstopping material includes a bend therein with the bend defining the vertical component 1901 and horizontal component 1903. The vertical component 1901 is angularly offset from the horizontal component 1903. The vertical component 1901 includes an aperture 2101 defined therein for receiving the pivot bar 307. The vertical component 1901 may include a post 1910 near the end thereof to snap into the balancer 300 for orientation. The vertical component 1901 is about 90 degrees offset from the horizontal component 1903. The vertical component 1901 and the horizontal component 1903 have a generally rectangular shape. The horizontal component 1903 has opposed flanges 1912 and 1914 extending outwardly as illustrated in FIG. 23. In one embodiment, the horizontal component 1903 may have an aperture (not shown) extending therethrough. It should be appreciated that the vertical component 1901 and the horizontal component 1903 may have any suitable shape. It should also be appreciated that the post 1910 is optional and is used only for alignment.

Figure 25:
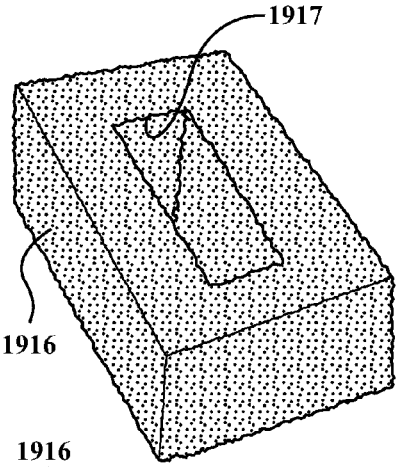
FIG. 25 is a perspective view of another embodiment of a foam seal for the draft guard of FIGS. 21 and 22.
Figure 24:
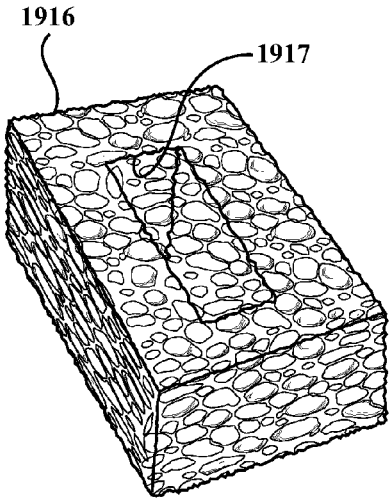
FIG. 24 is a perspective view of one embodiment of a foam seal for the draft guard of FIGS. 21 and 22.
Figure 26:
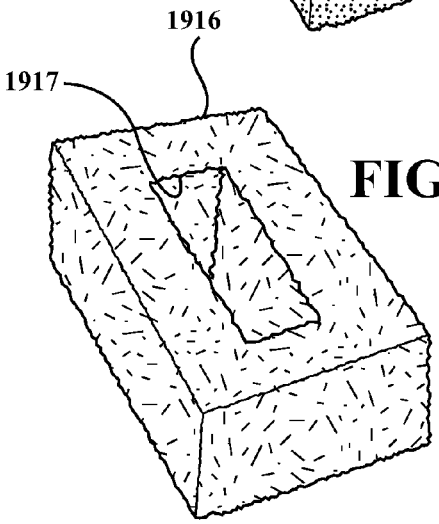
FIG. 26 is a perspective view of yet another embodiment of a foam seal for the draft guard of FIGS. 21 and 22.

The draft guard 1900 also includes a foam seal 1916 forming a closed member around the horizontal component 1903 and extending outwardly from the horizontal component 1903. The foam seal 1916 is formed or configured as a generally rectangular foam block. The foam seal 1916 has an opening or aperture 1917 extending therethrough. The opening 1917 may be any suitable size or shape, for example, oblong. The horizontal component 1903 passes through the opening 1917 such that the foam block expands to fit over the front flange 1912 and retracts to fit between the flanges 1912 and 1914. The foam seal 1916 is a compressible foam material. In one embodiment, the compressible foam material is an open cell foam as illustrated in FIG. 24. In another embodiment, the compressible foam material is a closed cell foam as illustrated in FIG. 25. In yet another embodiment, the compressible foam material is an articulated foam as illustrated in FIG. 26. The foam seal 1916 is disposed between the flanges 1912 and 1914 of the horizontal component 1903. In one embodiment, the flanges 1912 and 1914 are larger in size than the opening 1917 on both sides. In another embodiment, the flanges 1912 and 1914 are smaller that the foam block of the foam seal 1916. In yet another embodiment, the flanges 1912 and 1914 are of different sizes such that one of the flanges 1914 is larger in size than another one of the flanges 1912. The foam seal 1916 may have any suitable density, size, width, etc. It should be appreciated that the foam seal 1916 may be attached to the horizontal component 1903 by a suitable mechanism such as an adhesive, welding, friction fit, etc. It should also be appreciated that articulated foam is similar to a foam having threads with knots or a filter for a heating, ventilation, and air-conditioning system. It should further be appreciated that the foam block of the foam seal 1916 in various embodiments may have different thicknesses to contact the window sash 209, 211 and form a seal.

The draft guard 1900 further includes at least one fin 1918 extending outwardly from at least one side of the vertical component 1901. In one embodiment, a plurality of fins 1918 extends laterally across and spaced longitudinally along the vertical component 1901. One of the fins 1918 is spaced on one side of the aperture 2101 and at least another one of the fins 1918 is spaced on another side of the aperture 2101. In the embodiment illustrated, one of the fins 1918 is spaced between the aperture 2101 and the foam seal 1916 and a pair of fins 1918 is spaced from the aperture 2101 and the end of the vertical component 1901. The fins 1918 extend outwardly from the same side of the vertical component 1901. The fins 1918 are made of a flexible material. In one embodiment, the fins 1918 are made of a thermoplastic elastomer (TPE). The TPE has a predetermined hardness such as 40 duro. The fins 918 may be of different thicknesses or sizes. The fins 1918 and the weatherstopping material are integral. The fins 1918 may be co-injected molded or co-extruded with the vertical component 1901. It should be appreciated that the flexible material may be any suitable material. It should also be appreciated that the fins 1918 are made of a material soft enough to allow for flexing. It should further be appreciated that the fins 1918 may be welded by a bonding agent such as an adhesive onto the plastic of the vertical component 1901. It should further be appreciated that the fins 1918 may be made smaller or larger and the number of fins 1918 depends on the style of window, but are used only for double hung windows.

Figure 27:
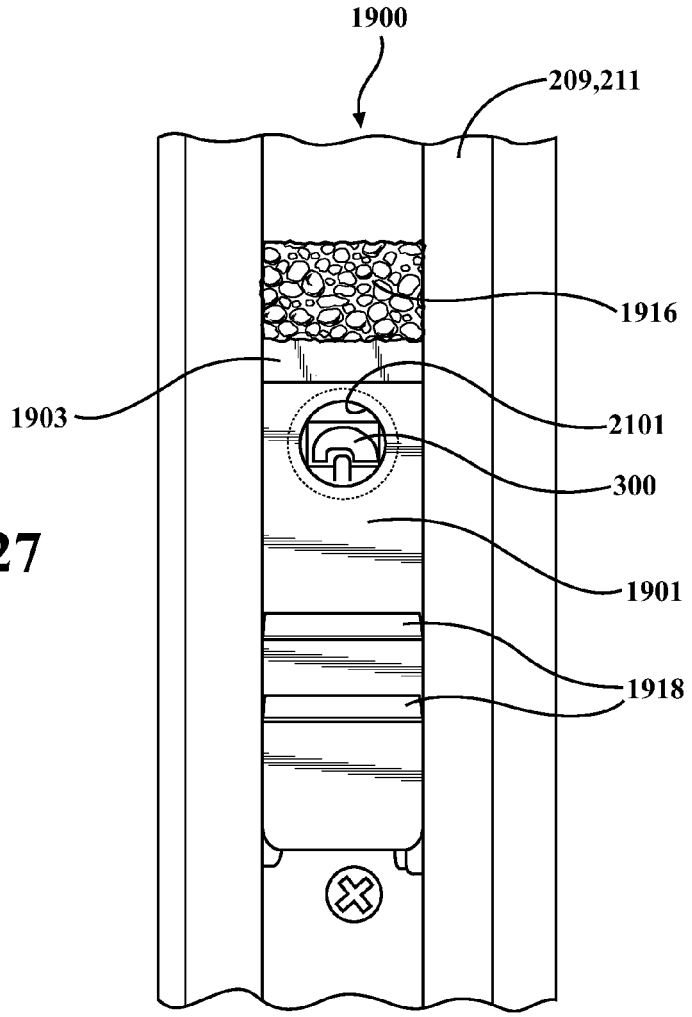
FIG. 27 is a plan view of the draft guard of FIGS. 21 and 22 illustrated in operational relationship with a window assembly.
Figure 28:
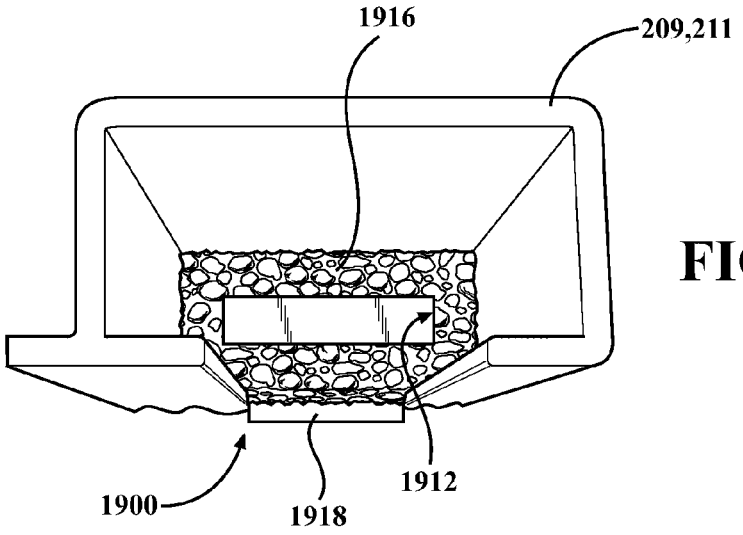
FIG. 28 is a fragmentary view of the draft guard and window assembly of FIG. 27.

In operation, as illustrated in FIGS. 27 and 28, the draft guard 1900 is illustrated in operational relationship with the window assembly. The draft guard 1900 is installed in the balancer 300 of the window assembly. The post 1910 on the draft guard 1900 snaps into the aperture on the balancer 300. In one embodiment, the draft guard 1900 is coupled to the sash component 303 of the balancer 300 with an adhesive. In another embodiment, the draft guard 1900 is mechanically coupled to the sash component 303 of the balancer 300. The foam seal 1916 fills up the space of the inside of the window jamb or sash 209, 211 and extends around the perimeter to seal off the inside of the window jamb or sash 209, 211. It should be appreciated that all parts seal in the same plane. It should also be appreciated that the foam seal 1916 touches all four surfaces inside of the window jamb or sash 209, 211

Accordingly, the draft guard 900, 1900 is used in a fenestration product such as a double hung window. It may be incorporated into the fenestration product during manufacture and assembly, or may, in some embodiments of the present invention, be added to an existing fenestration product either by fastening the draft guard 900, 1900 to an existing balancer or balancer shoe, or replacing the balancer with a new balancer or new balancer shoe having a draft guard. To manufacture a double hung window using the present invention, a sash side 303 of the balancer 300 and pivot bar 307 having a draft guard 900, 1900 is attached to a first sash, a frame side 301 of a balancer 300 is attached to a double hung window frame, the first sash is installed in the double hung window frame, and a spring 305 is connected between the sash side 303 of the balancer 300 having a draft guard 900, 1900 and the frame side 301 of the balancer 300. Modifications and variations to this manufacturing process may also be contemplated after reading this specification and viewing the attached drawings.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. A draft guard for a window assembly, said draft guard comprising:

a piece of weatherstopping material;

a bend in said piece of weatherstopping material with said bend defining a horizontal component and a vertical component angularly offset from said horizontal component;

a formed foam seal being a continuous member extending around a portion of said horizontal component and extending outwardly from said horizontal component, said foam seal having an opening with said horizontal component extending through said opening of said foam seal such that said foam seals extends around the portion of said horizontal component to offset said foam seal in a different plane from said vertical component; and at least one fin extending outwardly from and integral with at least one side of said vertical component.

2. A draft guard as set forth in claim 1 wherein said at least one fin comprises a plurality of fins extending laterally across and spaced longitudinally along said vertical component.

3. A draft guard as set forth in claim 2 wherein said vertical component includes an aperture defined therein for receiving a pivot bar.

4. A draft guard as set forth in claim 3 wherein said one of said fins is spaced on one side of said aperture and at least another one of said fins is spaced on another side of said aperture.

5. A draft guard as set forth in claim 2 wherein said fins extend outwardly from the same side of said vertical component.

6. A draft guard as set forth in claim 2 wherein said vertical component includes a post extending outwardly from a side opposite the side having said fins.

7. A draft guard as set forth in claim 1 wherein said foam seal comprises a compressible foam material.

8. A draft guard as set forth in claim 7 wherein said compressible foam material is an open cell foam.

9. A draft guard as set forth in claim 7 wherein said compressible foam material is a closed cell foam.

10. A draft guard as set forth in claim 7 wherein said compressible foam material is an articulated foam.

11. A draft guard as set forth in claim 1 wherein said fins are made of a thermoplastic elastomer (TPE).

12. A draft guard as set forth in claim 1 wherein said vertical component is about 90 degrees offset from a portion of said horizontal component.

13. A draft guard as set forth in claim 1 wherein said each of said vertical component and said horizontal component has a rectangular shape.

14. A draft guard as set forth in claim 1 wherein said horizontal component has opposed flanges extending outwardly, said foam seal being disposed between said flanges.

15. A draft guard as set forth in claim 1 wherein said foam seal is configured as a foam block.

16. A draft guard as set forth in claim 15 wherein said horizontal component has opposed flanges extending outwardly, said flanges being larger than said opening of said foam seal.

17. A draft guard as set forth in claim 15 wherein said horizontal component has opposed flanges extending outwardly, said flanges being smaller than said foam block.

18. A draft guard as set forth in claim 15 wherein said horizontal component has opposed flanges extending outwardly, one of said flanges being larger than another of said flanges.

19. A window assembly comprising:

a window frame;

first and second sashes contained in said window frame;

a balancer for containing said first and second sashes in said window frame, said balancer having a frame side component, a sash side component, and a spring connecting said frame side component and said sash side component; and a draft guard coupled to said sash side component of said balancer and having:

a piece of weatherstopping material;

a bend in said piece of weatherstopping material with said bend defining a horizontal component and a vertical component angularly offset from said horizontal component, wherein said vertical component has an aperture extending therethrough;

a foam seal being a continuous member extending around a portion of said horizontal component and extending outwardly from said horizontal component, said foam seal having an opening with said horizontal component extending through said opening of said foam seal such that said foam seals extends around the portion of said horizontal component to offset said foam seal in a different plane from said vertical component; and at least one fin extending outwardly from at least one side of said vertical component; and a pivot bar inserted into said aperture and coupled to said balancer.

20. A window assembly as set forth in claim 19 wherein said draft guard is coupled to said sash component with an adhesive.

21. A window assembly as set forth in claim 19 wherein said draft guard is mechanically coupled to said sash component.

22. A window assembly as set forth in claim 19 wherein said vertical component of said draft guard includes a post extending outwardly and mechanically coupled to said balancer of said sash component.

* * * * *